US007112947B2

(12) United States Patent
Draxelmayr

(10) Patent No.: US 7,112,947 B2
(45) Date of Patent: Sep. 26, 2006

(54) BANDGAP REFERENCE CURRENT SOURCE

(75) Inventor: Dieter Draxelmayr, Villach (AT)

(73) Assignee: Infineon Technologies AG, Munich (DE)

( * ) Notice: Subject to any disclaimer, the term of this patent is extended or adjusted under 35 U.S.C. 154(b) by 9 days.

(21) Appl. No.: 11/045,796

(22) Filed: Jan. 28, 2005

(65) Prior Publication Data

US 2005/0194954 A1 Sep. 8, 2005

(30) Foreign Application Priority Data

Jan. 28, 2004 (DE) ..... 10 2004 004 305

(51) Int. Cl.
*G05F 3/16* (2006.01)
*G05F 1/10* (2006.01)

(52) U.S. Cl. ..... 323/315; 327/539

(58) Field of Classification Search ..... 323/313, 323/314, 315, 316; 327/538, 539
See application file for complete search history.

(56) References Cited

U.S. PATENT DOCUMENTS 4,792,748 A 12/1988 Thomas et al.
5,013,934 A * 5/1991 Hobrecht et al. ..... 327/527

FOREIGN PATENT DOCUMENTS

DE 38 36 338 A1 5/1989
JP 05324108 A 12/1993

* cited by examiner

*Primary Examiner*—Shawn Riley
(74) *Attorney, Agent, or Firm*—Maginot, Moore & Beck

(57) ABSTRACT

Bandgap reference current source for generating a reference current ($I_{REF}$) having: at least two bipolar transistors ($T_1$, $T_2$), the base terminals ($B_1$, $B_2$) of which are interconnected and connected to a fixed reference potential, the collector terminals ($C_1$, $C_2$) of which are connected to a collector current ratio setting circuit (15, 16), which sets a specific current ratio (m) between the two collector currents ($I_{C1}$, $I_{C2}$) flowing through the collector terminals ($C_1$, $C_2$), and the emitter terminals ($E_1$, $E_2$) of which are connected via a first resistor ($R_A$) to a current node (13) which adds the emitter currents ($I_{E1}$, $I_{E2}$) flowing through the emitter terminals ($E_1$, $E_2$) to form a summation current ($I_{SUM}$), which forms the reference current ($I_{REF}$).

21 Claims, 5 Drawing Sheets

BANDGAP REFERENCE CURRENT SOURCE

FIELD OF THE INVENTION

The invention relates to a bandgap reference current source for generating a reference voltage.

BACKGROUND OF THE INVENTION

Bandgap reference current sources or bandgap circuits are in widespread use in integrated circuits.

FIG. 1 shows a subcircuit of a bandgap reference current source according to the prior art. The subcircuit in accordance with FIG. 1 contains an operational amplifier OP having an inverting input (−) and a noninverting input (+). The output of the operational amplifier OP supplies a voltage ($V_{REF}$), which is present at the gate terminals of two PMOS transistors $P_A$, $P_B$ in order to close a control loop. A supply voltage $V_{DD}$ is present at the PMOS transistor $P_A$, $P_B$. The first PMOS transistor $P_A$ is connected to the noninverting signal input (+) of the operational amplifier OP and, via a resistor $R_A$, to a diode $D_A$. The second PMOS transistor $P_B$ is connected to the inverting signal input (−) of the operational amplifier OP and is connected to ground via a diode $D_B$. The two diodes $D_A$ and $D_B$ have a specific current density ratio n.

The offset voltage of the operational amplifier greatly influences the accuracy of the circuit arrangement illustrated in FIG. 1. Ideally, the subcircuit supplies a current $$I_A = \frac{U_T}{R_A}.$$

lnn flowing through the resistor $R_A$. Since the voltage $U_T \cdot \ln n$ is small and generally has a value of 10 to 100 mV the current $I_A$ is greatly dependent on the offset voltage of the operational amplifier.

If the subcircuit illustrated in FIG. 1 is integrated on a chip, the diodes are formed in the form of pn junctions Drain/BULK or Well/Substrate.

FIG. 2 shows a bandgap reference voltage source according to the prior art, as is described for example in U. Tietze, C. H. Shenk, 11$^{th}$ Edition, Springer Verlag (ISBN 3-540-64192-0), on pp. 175–977.

The bandgap reference voltage source according to the prior art such as is illustrated in FIG. 2 likewise contains an operational amplifier OP having an inverting input (−) and a noninverting input (+), the inverting input being connected via a resistor $R_3$ to a supply voltage $V_{DD}$ and the noninverting input (+) being connected via a resistor $R_4$ to the supply voltage $V_{DD}$. The resistance of the resistor $R_4$ is a factor n lower than the resistance of the resistor $R_3$.

The bandgap reference voltage source according to the prior art such as is illustrated in FIG. 2 contains two bipolar transistors $T_1$, $T_2$, the collector terminal of the first bipolar transistor $T_1$ being connected to the resistor $R_3$ and the collector terminal of the second bipolar transistor $T_2$ being connected to the resistor $R_4$. The base terminals of the two bipolar transistors $T_1$, $T_2$ are connected to the output of the operational amplifier OP. The emitter terminal of the first bipolar transistor $T_1$ is connected to a potential node K via a resistor $R_1$. The emitter terminal of the second bipolar transistor $T_2$ is also connected to the potential node K. The potential node K is connected to ground via a resistor $R_2$.

The reference voltage $V_{REF}$ generated is present at the output of the operational amplifier OP.

The base-emitter voltage $U_{BE2}$ of the second transistor $T_2$ is used as a voltage reference, although the temperature coefficient thereof is very high with a value of −2 mV/K at 0.6 V. This temperature coefficient is compensated for by adding a voltage with a temperature coefficient of +2 mV/K. In the case of the bandgap reference voltage according to the prior art as illustrated in FIG. 2, said compensation voltage is generated by means of the second transistor $T_2$. The two bipolar transistors $T_1$, $T_2$ are operated with different collector currents $I_{C2} > I_{C1}$.

A voltage drop results on the transfer characteristic curve of the resistor $R_1$:

$$\begin{aligned} \Delta U_{BE} &= U_{BE_2} - U_{BE_1} \\ &= U_T \ln \frac{I_{C2}}{I_{C1}} \\ &= \frac{k \cdot T}{q} \ln \frac{I_{C2}}{I_{C1}} \end{aligned} \tag{1}$$

where T is the absolute temperature, and q is the elementary charge.

The voltage drop $\Delta U_{BE}$ is proportional to the voltage equivalent of thermal energy $U_T$ and thus proportional to the absolute temperature T.

A correspondingly larger voltage drop results at the resistor $R_2$ since not only the collector current $$I_{C1} = \frac{\Delta U_{BE}}{R_1},$$

but also the further collector current $I_{C2}$ flows through the resistor $R_2$.

The operation amplifier OP sets its output voltage in such a way that $I_{C2} = n \cdot I_{C1}$ holds true.

The following thus results:

$$\begin{aligned} U_{Temp} &= R_2(I_{C1} + I_{C2}) \\ &= R_2 \frac{\Delta U_{BE}}{R_1}(1+n) \\ &= U_T \frac{R_2}{R_1}(1+n)\ln n \\ &= A U_T \end{aligned} \tag{2}$$

$$\begin{aligned} U_{REF} &= U_{Temp} + U_{BE2} \\ &= \text{constant} \end{aligned} \tag{3}$$

Arbitrary gain factors A can be realized through the choice of the current ratio n and the resistance ratio $R_2/R_1$.

The bandgap reference voltage source according to the prior art as shown in FIG. 2 contains operational amplifier OP.

FIG. 3 shows a circuitry construction of a simple operational amplifier with a MOS differential amplifier stage.

Operational amplifiers that are integrated on a chip in CMOS technology have a high offset voltage. The bandgap reference voltage sources according to the prior art as shown in FIGS. 1, 2 are very sensitive toward alterations of the offset voltage of the operational amplifier OP, i.e. small changes in the offset voltage lead to high deviations in the reference voltage. The variation in the offset voltage caused by the production process thus leads to a high fluctuation of the reference voltage $V_{REF}$ output by the bandgap reference voltage source.

SUMMARY OF THE INVENTION

Therefore, the object is to provide a bandgap reference current source which generates a readily reproducible, accurate reference current that is insensitive to process variations.

This object is achieved according to the invention by means of a bandgap reference current source having the features of embodiment of the invention.

The invention provides a bandgap reference current source for generating a reference current having at least two bipolar transistors $T_1$, $T_2$, the base terminals $B_1$, $B_2$ of which are interconnected and connected to a fixed reference potential, the collector terminals $C_1$, $C_2$ of which are connected to a collector current ratio setting circuit, which sets a specific current ratio (m) between the two collector currents flowing through the collector terminals and the emitter terminals $E_1$, $E_2$ of which are connected via a first resistor $R_A$ to a current node which adds the emitter currents flowing through the emitter terminals to form a summation current ($I_{SUM}$), which forms the reference current ($I_{REF}$).

One advantage of the bandgap reference current source according to the invention is that the amplification is effected in one stage, i.e. no operational amplifier is necessary, with the result that a reference voltage generated is not altered by varying offset voltages.

This is because the amplifying components are formed by the two bipolar transistors $T_1$, $T_2$ themselves. In contrast to conventional bandgap circuits in bipolar technology, however, the circuit according to the invention is insensitive to variations in the current gain and Early voltage. A relatively accurate reference current $I_{REF}$ is generated even with a current gain of less than 1.0 V.

A further advantage of the reference current source according to the invention is that it requires a minimum supply voltage $V_{DD}$ of only approximately 1.0 V.

In one preferred embodiment of the bandgap reference current source according to the invention the summation current flowing at the current node is mirrored by means of current mirror transistors to form a mirrored summation current ($I_{SUM'}$), which flows through the second resistor ($R_B$) for generating a reference voltage ($V_{REF}$). The collector current ratio setting circuit preferably has a first reference current source pair which generates two reference currents ($I_{REF1}$, $I_{REF2}$) in the specific current ratio (m) and a second reference current source pair, which generates two reference currents ($I_{REF3}$, $I_{REF4}$) in the specific current ratio (m).

In one preferred embodiment, the first reference current source pair contains a first reference current source for generating a first reference current ($I_{REF1}$), and a second reference current source generating a second reference current ($I_{REF2}$).

In one preferred embodiment, the second reference current source pair contains has a third reference current source for generating a third reference current ($I_{REF3}$), and a fourth reference current source for generating a fourth reference current ($I_{REF4}$).

In one preferred embodiment, of the bandgap reference current source according to the invention, the first reference current source and the third reference current source are connected to the collector terminal ($C_1$) of the first bipolar transistor ($T_1$).

In one preferred embodiment, of the bandgap reference current source according to the invention, the second reference current source and the fourth reference current source are connected to the collector terminal ($C_2$) of the second bipolar transistor ($T_2$).

In one preferred embodiment, the first reference current source has a plurality (m) of MOS transistors connected up in parallel.

In one preferred embodiment, the third reference current source has a plurality (m) of MOS transistors connected up in parallel.

In a further preferred embodiment of the bandgap reference current source according to the invention, a cascode circuit is provided between the first reference current source pair and the collector terminals ($C_1$, $C_2$) of the bipolar transistors ($T_1$, $T_2$).

In one preferred embodiment of the bandgap reference current source according to the invention, the first reference current source pair is connected to a first supply voltage ($V_{DD}$).

In one preferred embodiment, the second reference current source pair is connected to a second supply voltage ($V_{SS}$).

In one preferred embodiment the second supply voltage ($V_{SS}$) forms the reference potential for the base terminals ($B_1$, $B_2$) of the bipolar transistors, ($T_1$, $T_2$).

In one preferred embodiment of the bandgap reference current source according to the invention, a third resistor $R_C$ is connected up between the current node (K) and the two base terminals ($B_1$, $B_2$), a diode current ($I_3$) flowing through said third resistor.

In one preferred embodiment, the resistors ($R_A$, $R_B$, $R_C$) are dimensioned in such a way that the reference voltage ($V_{REF}$) is temperature-compensated.

In one preferred embodiment of the bandgap reference current source according to the invention, the bandgap reference voltage source is an integrated circuit.

In one preferred embodiment, the bandgap reference voltage source is a CMOS circuit.

The bipolar transistors ($T_1$, $T_2$) are preferably parasitic bipolar transistors of the integrated circuit.

In this case, the bipolar transistors are PNP bipolar transistors in a first embodiment.

In a second embodiment, the bipolar transistors are NPN transistors.

In one preferred embodiment of the band gap reference current source according to the invention, the resistors ($R_A$, $R_B$, $R_C$) are integrated resistors produced from the same material.

In one preferred embodiment, the two bipolar transistors ($T_1$, $T_2$) have the same component parameters.

In a further preferred embodiment of the bandgap reference current source according to the invention, the two bipolar transistors ($T_1$, $T_2$) have a specific current density ratio $$n \cdot \left(\frac{I_{E1}}{I_{E2}}\right) = (n \cdot m).$$

Furthermore, preferred embodiments of the bandgap reference current source according to the invention are described with reference to the accompanying figures in order to elucidate features that are essential to the invention.

DETAILED DESCRIPTION OF THE INVENTION

Figure 1:
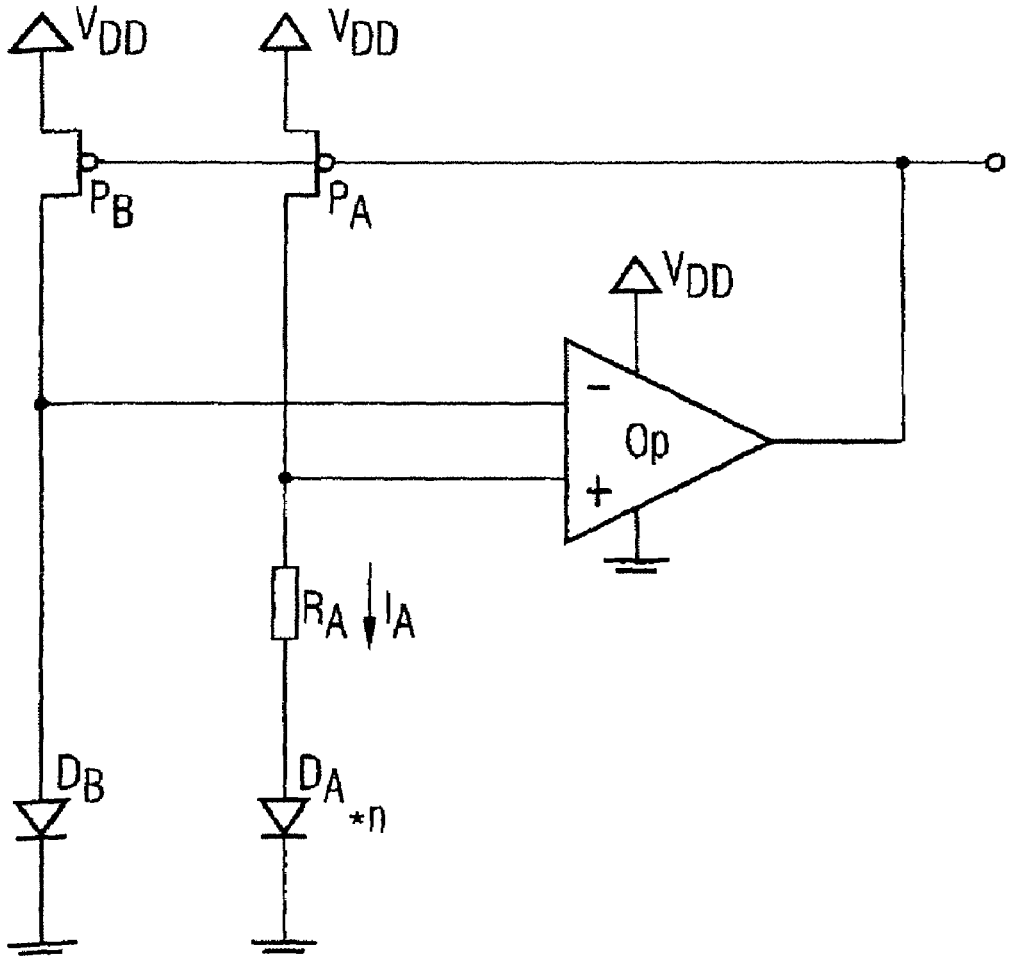
FIG 1 Prior Art
FIG. 1 shows the first subsection of a bandgap reference current source for generating a reference current according to the prior art.
Figure 2:
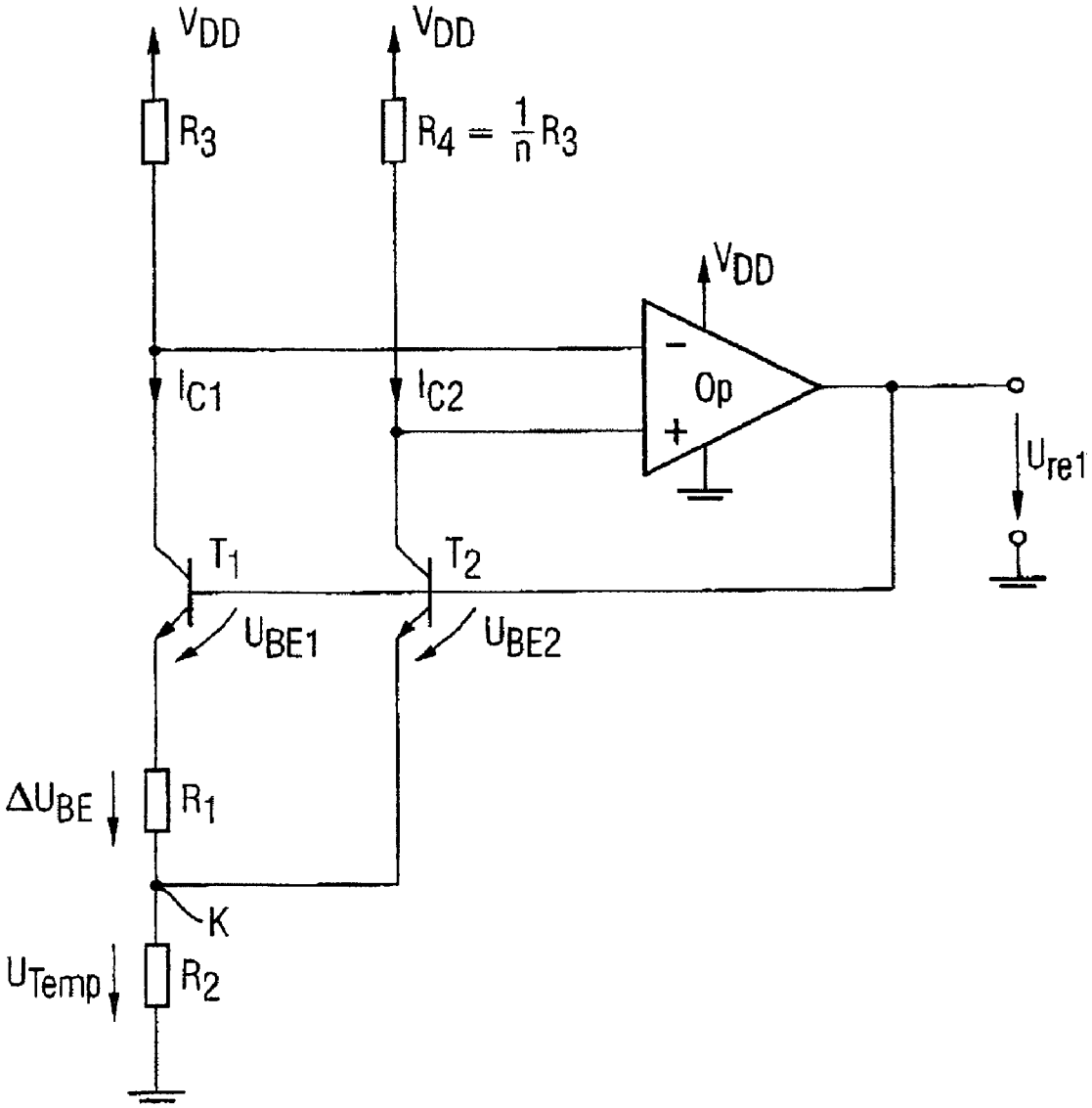
FIG 2 Prior Art
FIG. 2 shows a bandgap reference voltage source for generating a reference voltage according to the prior art.
Figure 3:
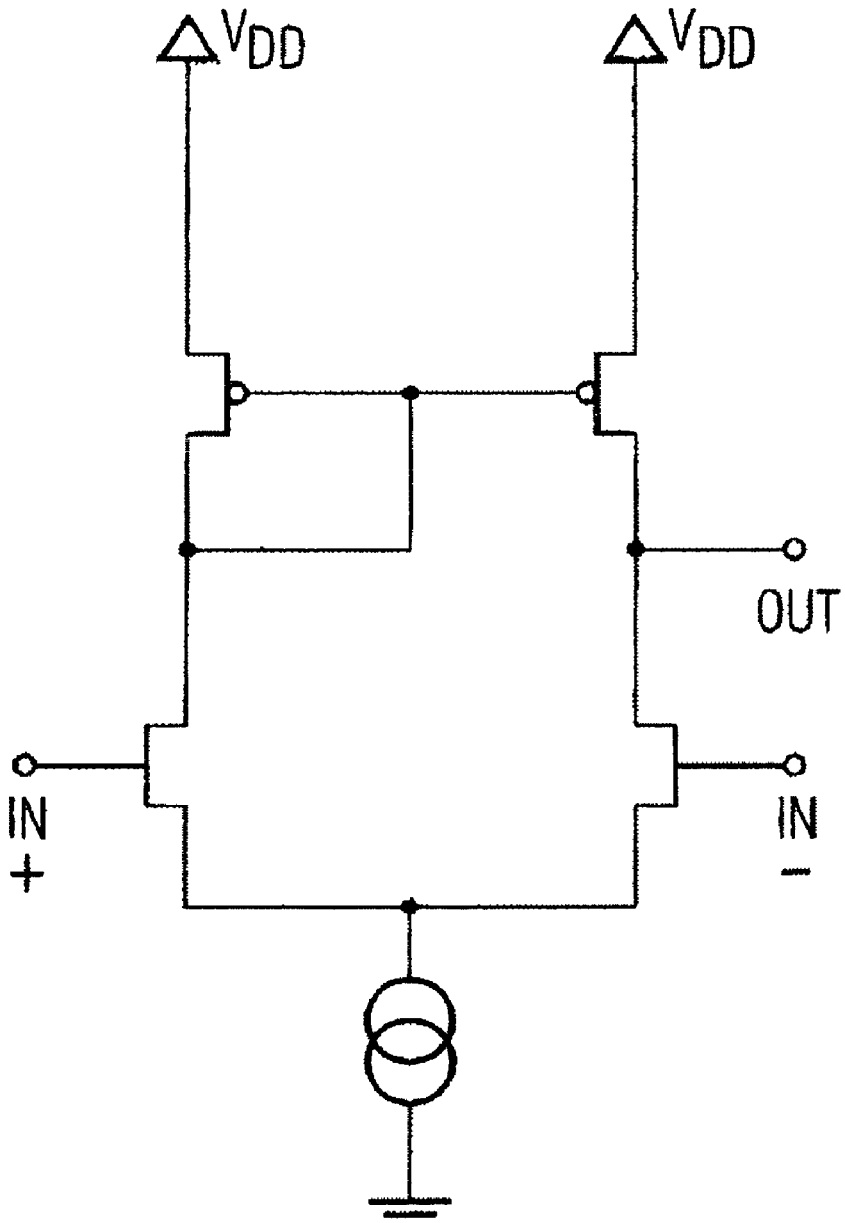
FIG 3 Prior Art
FIG. 3 shows a simple operational amplifier with a MOS differential amplifier stage according to the prior art.
Figure 4:
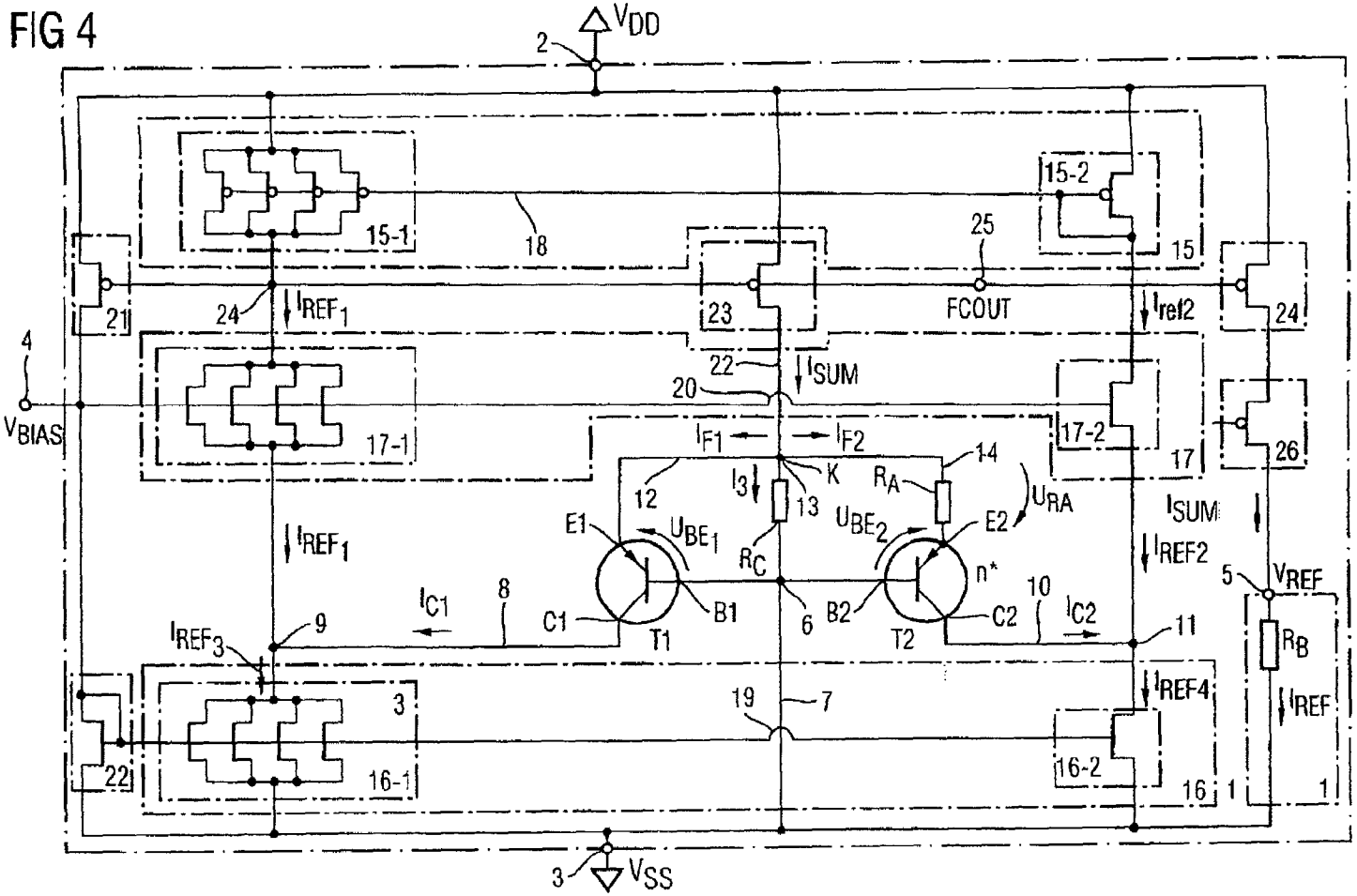
FIG. 4 shows a preferred embodiment of the bandgap reference current source according to the invention.

FIG. 4 shows a preferred embodiment of the bandgap reference current source 1 according to the invention. The reference current source 1 has a first supply voltage terminal 2 for applying a first supply voltage $V_{DD}$ and a second supply voltage terminal 3 for applying a second supply voltage $V_{SS}$. Moreover, a reference current source 1 has a terminal 4 for applying a Bias voltage ($V_{BIAS}$) and an output terminal 5 for outputting the reference current ($I_{REF}$).

The bandgap reference current source 1 contains two bipolar transistors $T_1$, $T_2$, the base terminals $B_1$, $B_2$ of which are interconnected at a node 6, the node 6 being connected to a fixed reference potential via a line 7. In the case of the preferred embodiment in FIG. 4, the fixed reference potential is formed by the second supply voltage $V_{SS}$. The collector terminal $C_1$ of the first bipolar transistor $T_1$ is connected to a node 9 via a line 8, the collector current $I_{C1}$ of the first bipolar transistor $T_1$ flowing via a line 8. The collector $C_2$ of the second bipolar transistor $T_2$ is connected to a further node 11 via a line 10, the collector current $I_{C2}$ of the second bipolar transistor $T_2$ flowing via a line 10. The emitter $E_1$ of the first bipolar transistor $T_1$ is connected via a line 12 to a current node 13, which is connected to the emitter $E_2$ of the second bipolar transistor $T_2$ via a line 14 and a first resistor $R_A$.

The bandgap reference current source 1 has two reference current source pairs 15, 16. The first reference current source pair 15 contains a first reference current source 15-1 and a second reference current source 15-2. The second reference current source pair 16 contains a first reference current source 16-1 and a second reference current source 16-2.

The two reference current source pairs 15, 16 in each case generate two reference currents, the current magnitudes of which have a specific current ratio (m). In the case of the preferred embodiment illustrated in FIG. 4, the current ratio m has a value of 4. The first reference current source pair 15 generates a first reference current $I_{REF1}$, and a second reference current $I_{REF2}$, which flow via a cascode circuit 17 to the collector terminal contacts 9, 11 of the bipolar transistors $T_1$, $T_2$.

The second reference current source pair 16 likewise generates two reference currents $I_{REF3}$, $I_{REF4}$, the current magnitudes of which have the same current ratio m. The first reference current source 15-1 generates the first reference current $I_{REF1}$, which has a current value four times higher than that of the second reference current $I_{REF2}$ generated by the second reference current source 15-2. In the case of the preferred embodiment illustrated in FIG. 4, the first reference current source 15-1 is formed by a plurality of PMOS transistors which are connected up in parallel and the gate terminals of which are connected to an identically constructed PMOS transistor of the second reference current source 15-2 via a line 18.

In the same way, the third reference current source 16-1, in the preferred embodiment illustrated in FIG. 4, is formed by a plurality of NMOS transistors which are connected up in parallel and the gate terminals of which are connected via a line 19 to an identically constructed NMOS transistor of the third reference-current source 16-2. The current ratio m between the reference currents $I_{REF}$ is defined by the number of MOS transistors connected up in parallel in the reference current sources 15-1, 16-1.

The following hold true:

$$I_{REF1}=m\cdot I_{REF2} \tag{4}$$

$$I_{REF3}=m\cdot I_{REF4} \tag{5}$$

$$I_{REF1}+I_{C1}=I_{REF3} \tag{6}$$

$$I_{REF2}+I_{C2}=I_{REF4} \tag{7}$$

$$m\cdot I_{REF2}+I_{C1}=I_{REF3} \tag{8}$$

$$m\cdot I_{REF2}+I_{C1}=m\cdot I_{REF4} \tag{9}$$

$$m\cdot I_{REF2}+I_{C1}=m\cdot I_{REF2}+m\cdot I_{C2} \tag{10}$$

$$I_{C1}=m\cdot I_{C2} \tag{11}$$

The two reference current source pairs 15, 16 form, together with the PMOS transistor 23, a collector current ratio setting circuit, which sets a specific current ratio m between the collector currents $I_{C1}$, $I_{C2}$ flowing through the collector terminals $C_1$, $C_2$. In the case of the preferred embodiment illustrated in FIG. 4, the collector current $I_{C1}$ flowing via the line 8 is four times as high as the collector current $I_{C2}$ flowing via the line 10.

The cascode circuit 17 contains a plurality of NMOS transistors 17-1 which are connected up in parallel and the gate terminals of which are connected via a line 20 to the gate terminal of an identically constructed NMOS transistor 17-2. The gate terminals of the NMOS transistors of the cascode circuit 17 are connected to the terminal 4 for applying a bias voltage. The bias voltage terminal 4 is connected to the supply voltage terminals 2, 3 via a PMOS transistor 21 and an NMOS transistor 22.

The parallel-connected PMOS transistors of the first current source 15-1, the parallel-connected NMOS transistors of the cascode circuit 17 and the parallel-connected NMOS transistors of the third current source 16-2 together form a first current path. A second current path is formed by the PMOS transistor of the second current source 15-2, by the PMOS transistor 17-2 of the cascode circuit 17 and by the PMOS transistor of the fourth reference current source 16-2.

In a preferred embodiment of the bandgap reference current source 1 according to the invention, the node 6 and the summation current node 13 are connected to one another via a third resistor $R_C$.

The following holds true in the settled state:

$$U_{BE_1}=U_{BE_2}-U_{RA} \tag{12}$$

In this case, the voltage $U_{RA}$ dropped across the first resistor $R_A$ is equal to:

$$U_{RA}=UT\cdot\ln(n\cdot m) \tag{13}$$

where m specifies the current ratio set by the collector current ratio setting circuit 15, 16, n represents an optionally provided emitter area ratio of the two bipolar transistors $T_1$, $T_2$, and n·m represents the current density ratio.

The following holds true for the voltage equivalent of thermal energy $U_T$:

$$U_T = \frac{k\cdot T}{q} \tag{14}$$

The following hold true for the currents present at the summation current node 13:

$$I_{E2} = \frac{U_{RA}}{R_A} = \frac{U_T\ln(n\cdot m)}{R_A} \tag{15}$$

$$I_{E1} = m\cdot I_{E_2} = m\cdot\frac{U_T}{R_A}\ln(n\cdot m) \tag{16}$$

$$I_3 = \frac{U_D}{R_C} \tag{17}$$

The summation current node 13 is connected to a first current mirror transistor 23 via a line 22. In the case of the preferred embodiment illustrated in FIG. 4, the first current mirror transistor 23 is formed by a PMOS transistor, the gate terminal of which is connected to the gate terminal of the PMOS transistor 21 and also the first current path. In addition, the gate terminal of the first current mirror transistor 23 is connected to the gate terminal of a second, identically constructed PMOS transistor 24 via a line 25.

A summation current $I_{SUM}$ flows on the line 22, in which case the following holds true:

$$I_{SUM} = I_{E1} + I_{E2} + I_3 = (m+1)\frac{U_T}{R_A}\ln(n\ \ m) + \frac{U_D}{R_C} \tag{18}$$

$$= \frac{(m+1)\ln(n\cdot m)}{R_A}\cdot\frac{k\cdot T}{q} + \frac{1}{R_C}\cdot U_D \tag{19}$$

In the case of the preferred embodiment illustrated in FIG. 4, the summation current $I_{SUM}$ formed is mirrored by means of the mirror transistors 23, 24 and conducted via an optionally provided PMOS transistor 26 via a second resistor $R_B$. A reference voltage $V_{REF}$ is generated at the second resistor $R_B$ as a result of the summation current $I_{SUM}$ flowing. The following holds true for the reference voltage $V_{REF}$:

$$V_{REF} = I_{SUM}\cdot R_B = \frac{R_B}{R_A}\cdot(m+1)\ln(n\cdot m)\cdot\frac{K\cdot T}{q} + \frac{R_B}{R_C}\cdot U_D = K_1\cdot U_T + K_2\cdot U_D \tag{20}$$

As can be discerned from equation (19), the generated reference voltage $V_{REF}$ is composed of a temperature-proportional voltage component ($K_1\cdot U_T$) and a voltage component ($K_2\cdot U_D$) dependent on the diode voltage. The temperature-proportional component has a positive temperature coefficient, while the voltage component dependent on the diode voltage has a negative temperature coefficient. Through suitable dimensioning of the resistors $R_A$, $R_B$, $R_C$ and of the current ratios n, m, it is possible to generate a temperature-compensated reference voltage.

An arbitrary reference voltage $V_{REF}$ can be generated by means of the dimensioning of the resistors $R_A$, $R_B$, $R_C$ and the current ratios.

As can be discerned from the equation (19), the current gains (β) of the two bipolar transistors $T_1$, $T_2$ have no influence on the magnitude of the reference voltage $V_{REF}$ generated. In the case of the bandgap reference current source 1 according to the invention, what is important is not the absolute current magnitude of the collector currents or the current gain β of the bipolar transistors $T_1$, $T_2$, but only the current ratio m between the current paths.

The production parameters of the two bipolar transistors $T_1$, $T_2$ can thus have poor properties just as long as they are identical. The bipolar transistors $T_1$, $T_2$ can even have a current gain which, under certain circumstances, is less than 1. In this case, the bipolar transistors $T_1$, $T_2$ are permitted to have a high substrate current component and a low early voltage. Absolute parameter properties of the two bipolar transistors $T_1$, $T_2$ have an effect only in as far as they influence the magnitude of $U_D$, as is the case in every bandgap circuit. The matching between the two bipolar transistors $T_1$, $T_2$ is crucial for the generation of the temperature-proportional voltage component. Since it is important merely for the two bipolar transistors to have the same parameter properties, the two bipolar transistors $T_1$, $T_2$ are arranged as close as possible to one another in the case of integration of the bandgap reference current source 1 according to the invention, with the result that the parameter properties are matched as well as possible.

Since the bandgap reference current source 1 according to the invention permits the absolute parameter properties of the two bipolar transistors $T_1$, $T_2$ to be able to be poor, it is also possible to realize the two bipolar transistors $T_1$, $T_2$ of a preferred embodiment by means of parasitic bipolar transistors.

Figure 5:
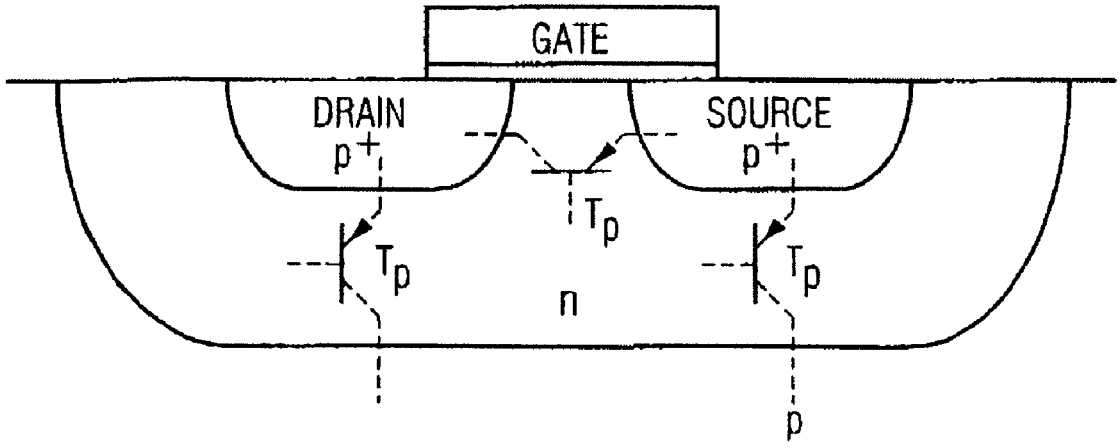
FIG. 5 shows a sectional view through an integrated circuit for elucidating the parasitic bipolar transistors connected up in a preferred embodiment.

FIG. 5 schematically shows the parasitic bipolar transistors $T_P$ present in an integrated MOS transistor. The MOS transistors produced during a CMOS process, for example, thus have parasitic bipolar transistors which can be connected up as bipolar transistors $T_1$, $T_2$ in accordance with FIG. 4.

The bandgap reference current source 1 according to the invention tolerates the poor component properties of the bipolar transistors $T_1$, $T_2$ without a disadvantageous influence on the reference voltage $V_{REF}$ generated as long as the parameters in the current gain, the substrate current component of the two bipolar transistors $T_1$, $T_2$ used, although poor, are nevertheless largely identical. This is the case particularly on integration of the bandgap reference current source 1 according to the invention.

The current sources 15-1, 15-2, 16-1, 16-2 of the reference current source 1 together form a folded cascode amplifier which reacts to a current imbalance at the node 24 with severe excursions. The PMOS transistor 23 is directly connected to the output 24 of the folded cascode amplifier and supplies the bandgap circuit, comprising the two bipolar transistors $T_1$, $T_2$ and the resistors $R_A$, $R_C$, with the summation current $I_{SUM}$. The base terminals $B_1$, $B_2$ of the two bipolar transistors $T_1$, $T_2$ are connected to the second supply voltage $V_{SS}$ via the line 7, the second supply voltage $V_{SS}$ preferably being formed by ground. Since the two base terminals $B_1$, $B_2$ are directly connected to ground, poor current gains of the two bipolar transistors $T_1$, $T_2$ are unimportant. A low early voltage of the two bipolar transistors has no adverse influence since the collectors $C_1$, $C_2$ are connected to the input terminals 9, 11 of a folded cascode amplifier which keeps the voltage at this node largely constant. Like the base current components, the substrate current components proportional to the operating current have no influence on the reference voltage because to a first approximation, all that is important is the ratio m between the two emitter currents $I_{E1}$, $I_{E2}$.

The bandgap circuit 1 according to the invention is insensitive to poor component data. According to the invention, the first resistor $R_A$ is connected up in the emitter path, the base terminals $B_1$, $B_2$ of the two bipolar transistors $T_1$, $T_2$ being interconnected and being supplied well by the reference potential. According to the invention, the collector currents $I_{C1}$, $I_{C2}$ are coupled out by means of a cascode circuit 17 and form a control output via a further current mirror. The emitter currents $I_{E1}$, $I_{E2}$ generate a temperature-proportional component of the reference voltage $V_{REF}$. In a preferred embodiment, the temperature-proportional component of the reference voltage can be temperature-compensated by a diode component by additionally providing a resistor $R_C$ connected in parallel with the resistor $R_A$.

The bandgap reference current source 1 according to the invention is distinguished by the fact that it can be operated with a very low supply voltage $V_{DD}$, the supply voltage being 1 V by way of example. This corresponds to a diode voltage and a saturation voltage. The bandgap circuit 1 according to the invention is outstandingly suitable for integration in an integrated circuit since the absolute component properties of the bipolar transistor $T_1$, $T_2$ have no adverse influence on the reference voltage $V_{REF}$.

The invention claimed is:

1. A bandgap reference current source for generating a reference current ($I_{REF}$) having:

(a) at least two bipolar transistors having base terminals that are interconnected and connected to a fixed reference potential, the at least two bipolar transistors having collector terminals that are connected to a collector current ratio setting circuit configured to set a specific current ratio (m) between two collector currents flowing through the collector terminals, the at least two bipolar transistors having emitter terminals that are connected via a first resistor to a current node, the current node configured to add emitter currents flowing through the emitter terminals to form a summation current from which the reference current is formed, the current node also connected to a second resistor, the second resistor being further operably connected to the two base terminals, said second resistor configured to receive a first current ($I_3$) flowing therethrough, (b) the collector current ratio setting circuit, comprising a first reference current source pair configured to generate first and second reference currents in the specific current ratio (m) and a second reference current source pair configured to generate third and fourth reference currents in the specific current ratio (m).

2. The bandgap reference current source as claimed in claim 1, further comprising current mirror transistors configured to form a mirrored summation current from the summation current, and further comprising a third resistor configured to receive the mirrored summation current and generate a reference voltage therefrom.

3. The bandgap reference current source as claimed in claim 2, wherein the first reference current source pair comprises a first reference current source configured to generate the first reference current, and a second reference current source configured to generate the second reference current.

4. The bandgap reference current source as claimed in claim 3, wherein the second reference current source pair comprises a third reference current source configured to generate the third reference current, and a fourth reference current source configured to generate the fourth reference current.

5. The bandgap reference current source as claimed in claim 4, wherein the first reference current source and the third reference current source are connected to the collector terminal of a first bipolar transistor of the at least two bipolar transistors.

6. The bandgap reference current source as claimed in claim 5, wherein the second reference current source and the fourth reference current source are connected to the collector terminal of a second bipolar transistor of the at least two bipolar transistors.

7. The bandgap reference current source as claimed in claim 3, wherein the first reference current source has a plurality (m) of MOS transistors connected in parallel.

8. The bandgap reference current source as claimed in claim 1, further comprising a cascade circuit coupled between the first reference current source pair and the collector terminals of the at least two bipolar transistors.

9. The bandgap reference current source as claimed in claim 1, wherein the first reference current source pair is connected to a first supply voltage.

10. The bandgap reference current source as claimed in claim 9, wherein the second reference current source pair is connected to a second supply voltage.

11. The bandgap reference current source as claimed in claim 10, wherein the second supply voltage forms a reference potential for the base terminals of the at least two bipolar transistors.

12. The bandgap reference current source as claimed in claim 2, wherein the first, second and third resistors are dimensioned in such a way that the reference voltage generated is temperature-compensated.

13. The bandgap reference current source as claimed in claim 1, wherein the bandgap reference voltage source comprises an integrated circuit.

14. The bandgap reference current source as claimed in claim 13, wherein the bandgap reference voltage source comprises an integrated CMOS circuit.

15. The bandgap reference current source as claimed in claim 13, wherein the at least two bipolar transistors comprise parasitic bipolar transistors of the integrated circuit.

16. The bandgap reference current source as claimed in claim 1, wherein the at least two bipolar transistors comprise PNP transistors.

17. The bandgap reference current source as claimed in claim 1, wherein the at least two bipolar transistors are NPN transistors.

18. The bandgap reference current source as claimed in claim 13, wherein the resistors comprise integrated resistors constructed at least in part of the same material.

19. The bandgap reference current source as claimed in claim 1, wherein the at least two bipolar transistors have substantially similar component parameters.

20. The bandgap reference current source as claimed in claim 1, wherein the at least two bipolar transistors have a specific current density ratio (n).

21. A bandgap reference current source for generating a reference current ($I_{REF}$) comprising:

(a) at least two bipolar transistors having base terminals that are interconnected and connected to a fixed reference potential, the at least two bipolar transistors having collector terminals that are connected to a collector current ratio setting circuit configured to set a specific current ratio (m) between two collector currents flowing through the collector terminals, the at least two bipolar transistors having emitter terminals that are connected via a first resistor to a current node, the current node configured to add emitter currents flowing through the emitter terminals to form a summation current from which the reference current is formed, the current node also connected to a second resistor, the second resistor being further operably connected to the two base terminals, said second resistor configured to receive a first current ($I_3$) flowing therethrough, (b) the collector current ratio setting circuit, comprising a first reference current source configured to generate two reference currents in the specific current ratio (m) and a second reference current source configured to generate two currents in the specific current ratio (m).

* * * * *